US005435107A

United States Patent [19]

Seibold

[11] Patent Number: 5,435,107

[45] Date of Patent: Jul. 25, 1995

[54] BRACKET FOR REPAIRING AN ATTACHMENT OF AN OUTER FACADE ELEMENT TO AN INNER LOAD-BEARING MEMBER

[75] Inventor: Günter Seibold, Pfalzgrafenweiler, Germany

[73] Assignee: fischerwerke, Artur Fischer GmbH & Co. KG, Waldachtal, Germany

[21] Appl. No.: 108,632

[22] Filed: Aug. 25, 1993

[30] Foreign Application Priority Data

Apr. 11, 1992 [DE] Germany ..... 92 05 082.4
Nov. 28, 1992 [DE] Germany ..... 92 16 236.3

[51] Int. Cl.[6] ..... E04H 1/00
[52] U.S. Cl. ..... 52/235; 52/126.4
[58] Field of Search ..... 52/235, 126.4, 126.6, 52/126.3, 126.7, 698, 506.01, 506.05, 513

[56] References Cited

U.S. PATENT DOCUMENTS 5,067,292 11/1991 Finean ..... 52/126.4 X
5,158,392 10/1992 Takeda ..... 52/235 X

*Primary Examiner*—Carl D. Friedman
*Assistant Examiner*—Creighton Smith
*Attorney, Agent, or Firm*—Michael J. Striker

[57] ABSTRACT

The bracket for repairing an attachment of an outer facade element to a load-bearing concrete member includes a flange attachable to the load-bearing concrete member; a supporting arm attached to the flange and provided with a longitudinal slot; and a jack mountable in the longitudinal slot in the supporting arm for support of the outer facade element. The jack is adjustably positionable in the longitudinal slot of the supporting arm in a longitudinal direction of the supporting arm to compensate for different spacings of the outer facade element from the load-bearing concrete member. The jack includes a threaded bolt having a head; a bearing plate attached to the head for bearing on the outer facade element and a support plate secured to the bolt and bearing on the supporting arm. The bearing plate is arched transversely to the longitudinal direction of the supporting arm so as to be engagable with a curved surface of a hole drilled in the outer facade element.

7 Claims, 4 Drawing Sheets

BRACKET FOR REPAIRING AN ATTACHMENT OF AN OUTER FACADE ELEMENT TO AN INNER LOAD-BEARING MEMBER

BACKGROUND OF THE INVENTION

The invention relates to a bracket for the repair of an attachment of an outer facade element to an inner load-bearing member. This bracket includes a flange that can be attached to a load-bearing concrete member and a supporting arm which engages in a drilled hole in the outer facade element and supports the latter.

In conventional slab construction, the outer facade element is connected to the load-bearing inner concrete member by steel anchoring means which were anchored in concrete, with a cavity being formed between the load-bearing inner concrete member and the outer facade element. As a rule, the cavity is filled with slabs of packing material for insulation. Through the effects of weathering and corrosion of the steel anchoring means, safety risks arise for the attachment, which make repair of the fixing necessary. For repair it is known to use a tubular bracket, which is pushed through a drilled hole in the outer facade element and let into an annular groove of the load-bearing concrete member. Into the tube there is welded a web, by which it is possible, by means of a fastening anchor bolt, to brace and fasten the tube to the load-bearing concrete member. By means of an obliquely extending end edge of the tubular bracket, during the bracing against the load-bearing concrete member a pre-stressing of the outer facade element to take up the load is achieved.

The drawbacks of this known bracket for the repair of the attached facade member consist in that in the load-bearing concrete member an annular gap corresponding to the cross-section of the bracket has to be produced. Moreover, because of the coupling of the attachment of the bracket to the load-bearing concrete member with the pre-stressing for the outer facade element, no individual pre-stressing of the outer shell is possible. The pre-stressing is moreover achieved by oblique bracing of the bracket which leads to one-sided support, based only on linear contact, in the drilled hole, of the outer facade element.

SUMMARY OF THE INVENTION

It is an object of the present invention to provide a bracket for the repair of an attachment of an outer facade element to a load-bearing concrete member, which is easy to install and which makes possible flat support, beginning in the center of the outer shell, for the pre-stressing of the outer facade element.

According to the invention, the bracket for repairing an attachment of an outer facade element to a load-bearing concrete member comprises a flange attachable to the load-bearing concrete member; a supporting arm attached to the flange and having a longitudinal direction, said supporting arm being provided with a longitudinal slot extending in the longitudinal direction; and a jack mountable in the longitudinal slot in the supporting arm for support of the outer facade element. The jack is adjustably positionable in the longitudinal slot of the supporting arm in the longitudinal direction on the supporting arm to compensate for different spacings of the outer facade element from the load-bearing concrete member. The jack includes a threaded bolt having a head and a bearing plate attached to the head for bearing on the outer facade element and the bearing plate is arched transversely to the longitudinal direction of the supporting arm. By the angular shape of the bracket, the latter, in spite of a relatively long flange forming the part bearing against the load-bearing concrete member, can be pushed through a small drilled hole in the outer facade element for installation. The bracket is attached to the load-bearing concrete member by a fastening anchor bolt in such a way that the supporting arm of the bracket is flush with the drilled hole in the outer facade element. The jack inserted in a slot in the supporting arm, after it has been aligned in the slot with the center of the outer facade element, is pre-stressed by a nut, bearing on the supporting arm, against the inner wall of the drilled hole in the outer facade element. The loads resulting from the outer facade element are thus applied by the jack and the bracket into the load-bearing concrete member, and dropping of the outer facade element on subsequent failure of the old anchoring means is prevented. Owing to the fact that the jack is displaceable in the slot in the supporting arm, the bracket can be adjusted for different spacings of the slabs forming the outer facade element from the inner concrete shell.

The jack formed by a threaded bolt and a bearing plate which is attached to the head of the latter and is arched transversely to the longitudinal direction of the supporting arm, allows a flat seating against the inner wall of the drilled hole in the outer facade element. Stress peaks, which under certain circumstances can lead to breaking out of the drilled hole in the case of additional loads due to heat expansion, are thus avoided.

Through excessive pre-stressing on the one hand, or as a result of the supporting arm not being aligned exactly parallel to the axis in the drilled hole in the outer shell, the jack becomes tilted somewhat during bracing between the supporting arm and the wall of the drilled hole in the outer facade element, so that unfavourable bending moments act on the jack. In order to avoid these bending moments and tilting, in a further embodiment of the invention it is proposed that the jack be supported on the supporting arm by a support plate, of which the surface bearing on the supporting arm is arched in the longitudinal direction of the supporting arm. For locking and aligning the support plate on the supporting arm, the bearing surface of the support plate is divided by a central web which engages in the slot of the supporting arm.

In the case of a more oblique positioning of the jack, under certain circumstances the support plate could slide off the supporting arm, especially as a result of vibration loadings due to wind pressure forces. It is therefore expedient to provide both the arched bearing surface of the support plate and also the bearing surface of the supporting arm with tooth-like ribs arranged transversely to the slot of the supporting arm. As the radius (R) for the arching, a dimension which corresponds approximately to the length of the jack is recommended.

BRIEF DESCRIPTION OF THE DRAWING

Exemplary embodiments of the invention are illustrated in the drawing, in which.

DESCRIPTION OF THE PREFERRED EMBODIMENTS

Figure 1:
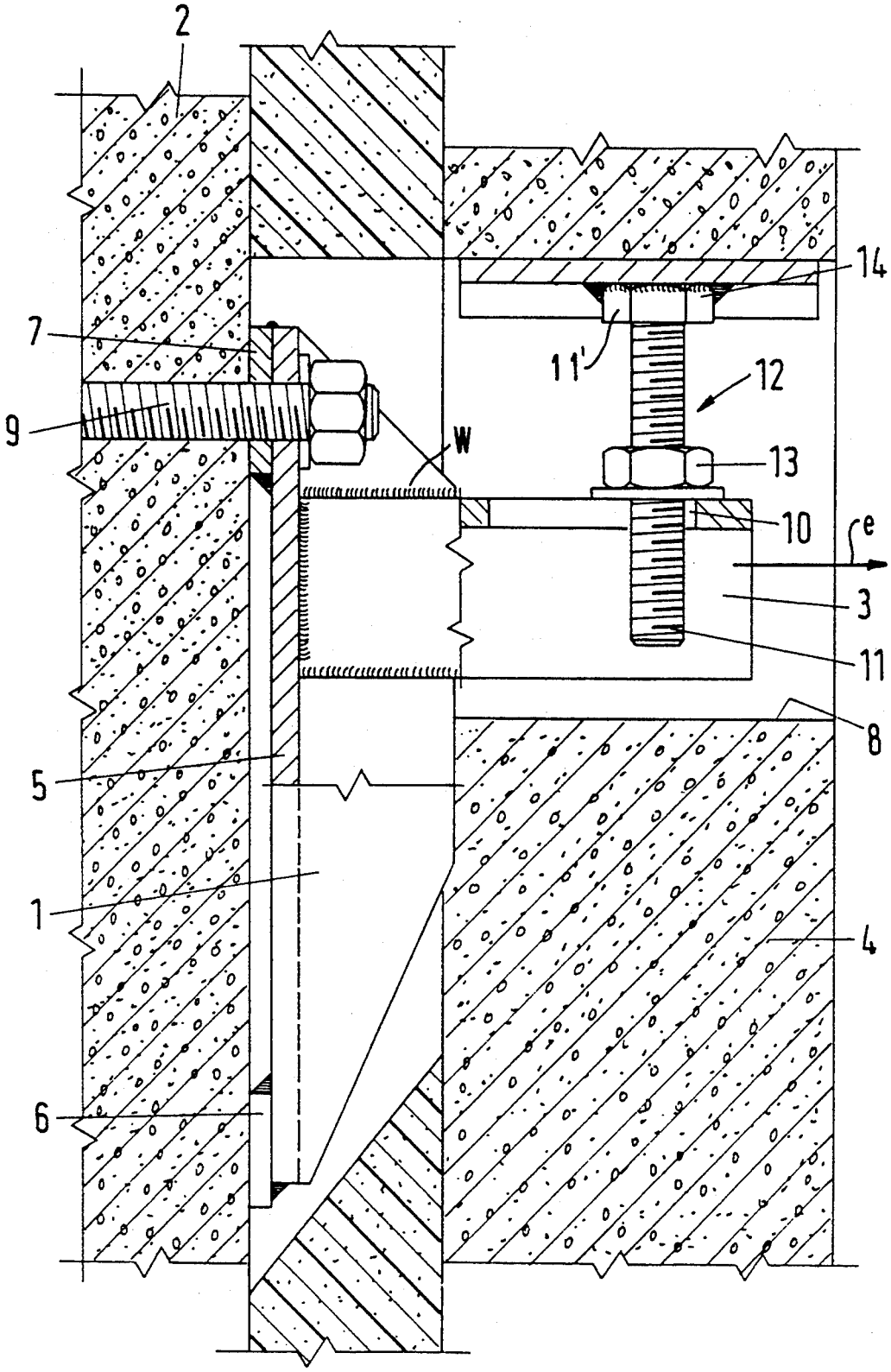
FIG. 1 is a partially cross-sectional, partially side view of one embodiment of a bracket according to the invention shown supporting an outer facade element on an inner load-bearing member, the latter being shown in cross-section.

The bracket consists of two U-shaped section pieces fitted into each other at right-angles and to form weld joint W welded, the longer piece of section, as the flange 1, providing the surface which bears on the load-bearing concrete member 2, and the other piece of section forming the supporting arm 3 for the outer shell 4. In order to improve the bearing on the load-bearing concrete member 2, bearing plates 6, 7 are welded on the bottom web 5 of the flange 1 in the region of the two outer ends.

For fitting the bracket, there is provided in the outer shell 4 a-drilled hole 8 through which the bracket is inserted and placed on the load-bearing concrete member 2. With a fastening anchor bolt 9, the bracket is attached to the concrete member in such a way that the supporting arm is flush with the drilled hole 8 of the outer shell. Into longitudinal slot 10 of the supporting arm 3 the threaded bolt 11 of the jack 12 with a nut 13 screwed on is now inserted, and displaced in the slot until the bearing plate 14 welded on the head 11' of the threaded bolt 11 is located in the middle of the outer shell 4. By turning the nut 13, the jack 12 is pre-stressed against the inner wall of the drilled hole 8. In order to obtain a flat seating against the inner wall of the drilled hole, the bearing plate 14 is arched, transversely to the longitudinal direction of the supporting arm, with a radius which corresponds to the radius of the drilled hole 8.

The load of the outer shell 4 is now transmitted by the jack 12 and the bracket into the load-bearing concrete member 2. This prevents the outer shell 4 from dropping, on subsequent failure of the old anchoring means. The outer shell 4 can now be rendered, or cladding can be applied to it.

Figure 2:
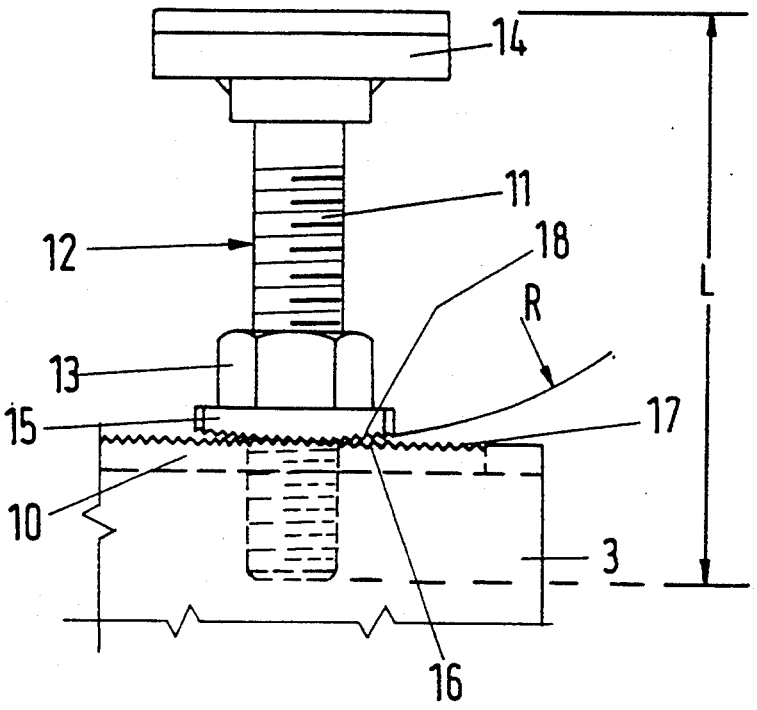
FIG. 2 is a side elevational view of a jack in the bracket shown in FIG. 1 bearing on a supporting arm of the bracket via a plate.

The jack 12 illustrated in FIG. 2 is supported on the supporting arm 3 by the plate 15. This support plate has an arched bearing surface 16 so that crooked bracing of the jack 12 cannot occur. In order to prevent the support plate from sliding off when the jack 12 is in an excessively inclined position, both the arched bearing surface 16 of the support plate 15 and the bearing surface 17 of the supporting arm 3 are provided with tooth-like ribs 18 arranged transversely to the slot 10.

Figure 3:
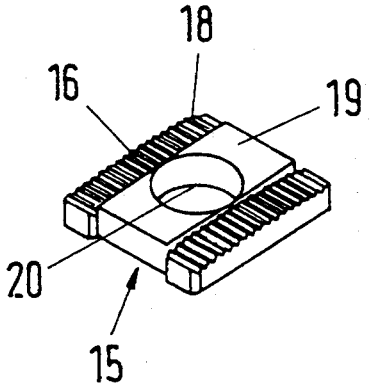
FIG. 3 is a perspective view of a supporting plate used with the jack shown in FIG. 2.

In FIG. 3 it can be seen that the arched bearing surface 16 of the support plate 15 is divided by an elevated central web 19 engaging in the longitudinal slot 10. By means of this central web 19 it is ensured that the support plate 15 lies straight on the supporting arm. The threaded bolt 11 of the jack 12 is placed through the drilled hole 20 in the support plate 15 so that the nut 13 sits on the support plate 15 for supporting the jack 12. The radius R of the arched bearing surface 16 of the support plate 15 corresponds approximately to the total length of the jack 12.

Figure 4:
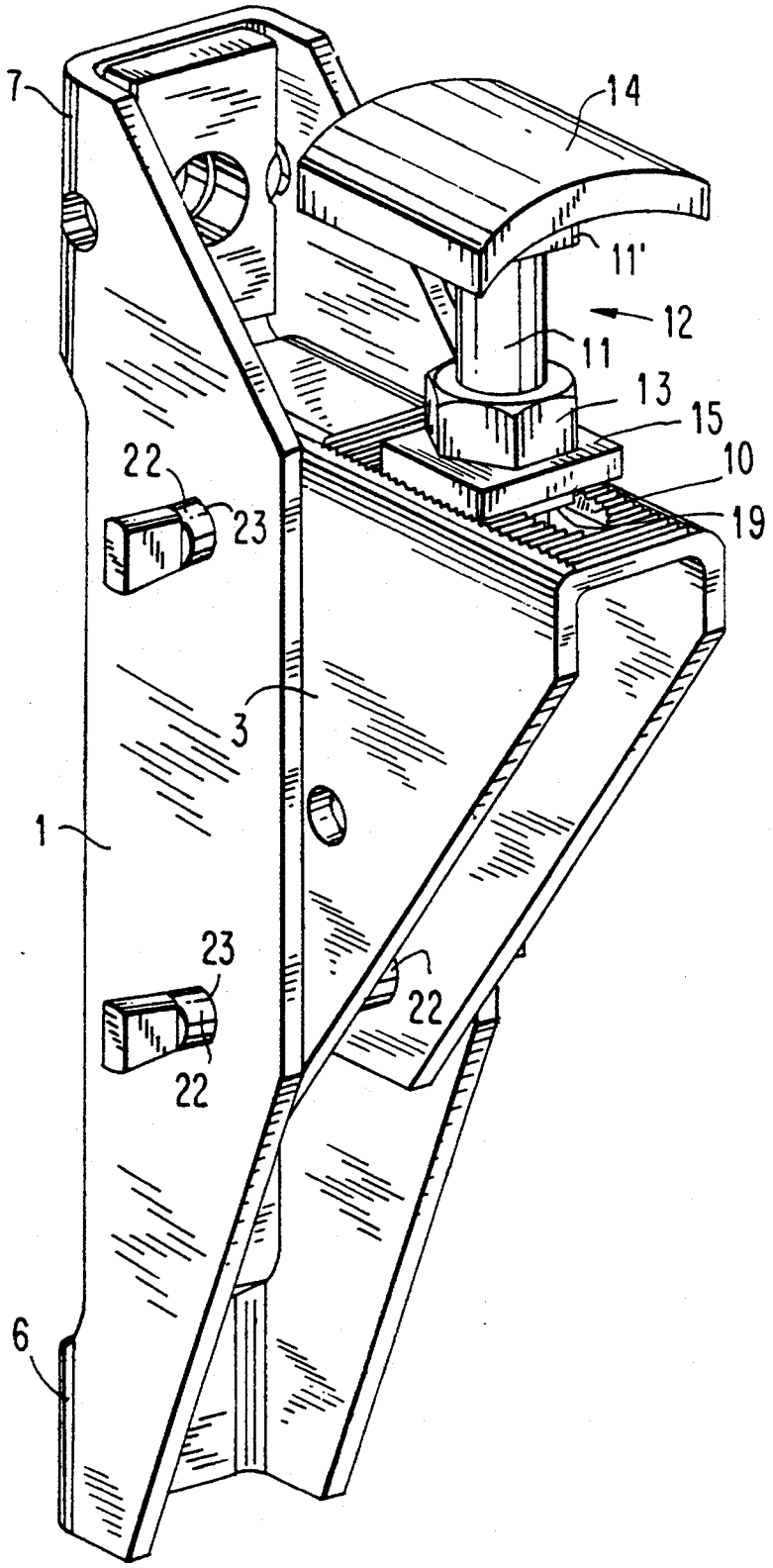
FIG. 4 is a perspective view of another embodiment of a bracket according to the invention in which the section pieces are held together by pins.

FIG. 4 shows another embodiment of the bracket according to the invention in which the supporting arm 3 is attached to the flange 1 via pins 22 which pass through holes 23 provided in the flange 1 and supporting arm 3. The ends of these pins 22 are advantageously flattened so that they will not work out of the holes 23. The jack 12 in the embodiment shown in FIG. 4 is the same as the jack 12 of FIG. 2 and is slidable in the longitudinally elongated hole or slot 10 during installation to adjust its distance from the inner load-bearing member. Other parts of the jack 12 with the same reference number as in FIG. 2 are the same as in FIG. 2 and the jack 12 operates in the same way. The web 19 of plate 15 is shown engaged in the slot 10. The bolt 9 with its nut is of course not shown in FIG. 4.

Figure 5:
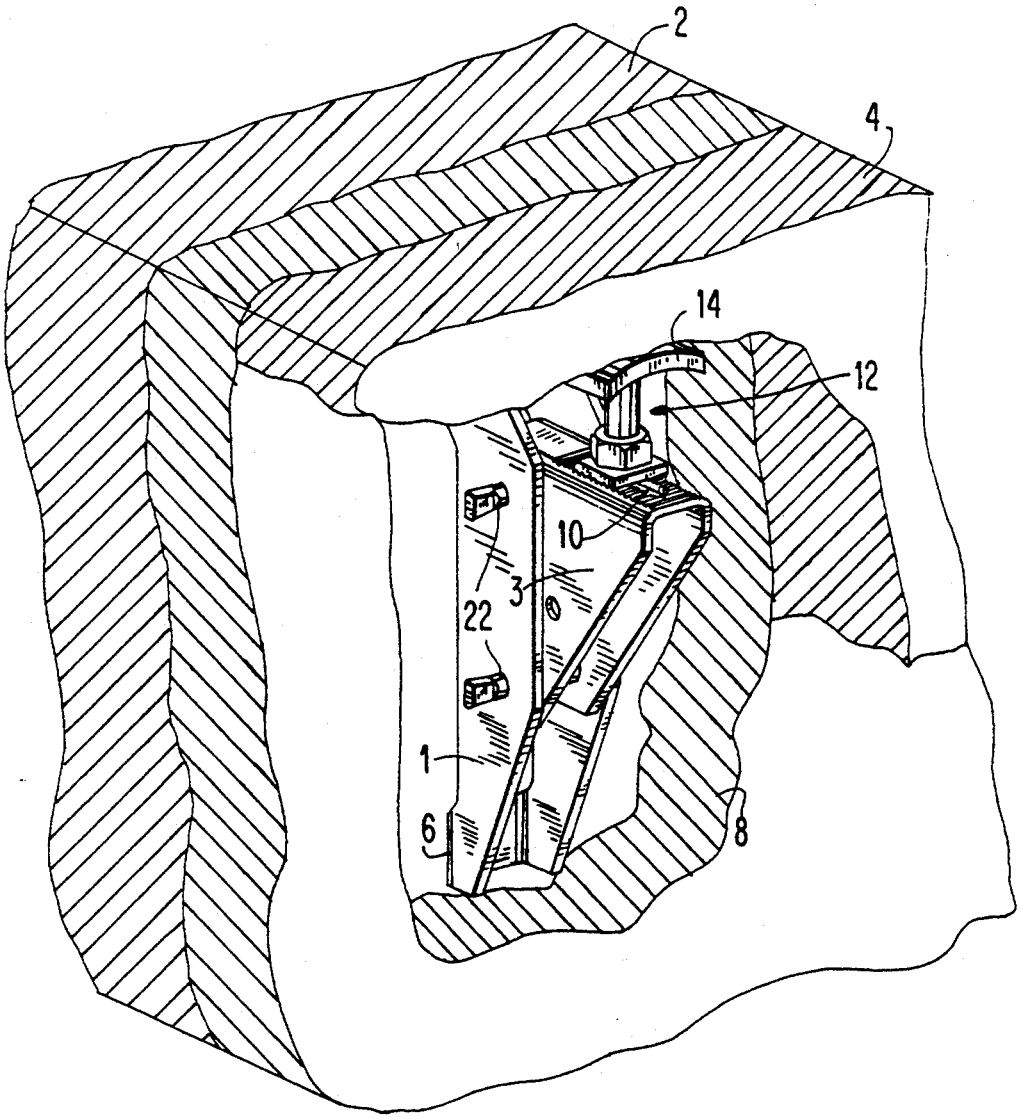
FIG. 5 is a perspective view of the bracket shown in FIG. 4 installed supporting an outer facade element on an inner load-bearing member.

FIG. 5 shows the bracket of FIG. 4 installed to provide alternative support for an outer facade element 4 on an inner load-bearing member 2 to thus repair the attachment. A hole 8 is drilled in the outer facade element 4 for insertion of the bracket and the jack 12 is then adjusted to provide the alternative support for the outer facade element 4.

By the sections of the bracket being connected at "right angles" to each other we mean that the longitudinal direction 1 of the supporting arm 3 is perpendicular to the longitudinal direction in which the flange extends.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

What is claimed is:

1. Bracket for repairing an attachment of an outer facade element to a load-bearing concrete member, said bracket comprising a flange attachable to the load-bearing concrete member;

a supporting arm attached to said flange and said supporting arm being provided with a longitudinal slot; and a jack mountable in said longitudinal slot in said supporting arm to support said Outer facade element, wherein said jack is adjustably positionable in said longitudinal slot of said supporting arm in a longitudinal direction of said supporting arm to compensate for different spacings of said outer facade element from said load-bearing concrete member, said jack comprises a threaded bolt having a head and a bearing plate attached to said head for bearing on said outer facade element and said bearing plate is arched transversely to said longitudinal direction of said supporting arm.

2. Bracket as defined in claim 1, wherein said flange and said supporting arm are attached to each other by welding.

3. Bracket as defined in claim 1, wherein said flange and said supporting arm are attached to each other by pins.

4. Bracket as defined in claim 1, wherein said jack includes a support plate for support of said jack on said supporting arm and said support plate has a bearing surface contacting said supporting arm and said bearing surface is arched in said longitudinal direction of said supporting arm.

5. Bracket as defined in claim 4, wherein said bearing surface of said support plate has a curvature radius (R) approximately equal to a total length (L) of said jack.

6. Bracket as defined in claim 4, wherein said support plate has a central web dividing said bearing surface of said support plate and said central web is engagable in said longitudinal slot in said supporting arm.

7. Bracket as defined in claim 4, wherein said bearing surface of said support plate and a surface of said supporting arm contacted by said bearing surface are provided with opposing tooth-like ribs extending transversely to said longitudinal slot of said supporting arm.

* * * * *